US010072653B2

(12) United States Patent
Mellar

(10) Patent No.: US 10,072,653 B2
(45) Date of Patent: Sep. 11, 2018

(54) DEVICE FOR CONSERVING POWER IN A PISTON COMPRESSOR

(71) Applicant: KNORR-BREMSE Systeme fuer Nutzfahrzeuge GmbH, Munich (DE)

(72) Inventor: Joerg Mellar, Pliening (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 315 days.

(21) Appl. No.: 14/879,219

(22) Filed: Oct. 9, 2015

(65) Prior Publication Data

US 2016/0032917 A1 Feb. 4, 2016

Related U.S. Application Data

(63) Continuation of application No. PCT/EP2014/000908, filed on Apr. 4, 2014.

(30) Foreign Application Priority Data

Apr. 10, 2013 (DE) ..... 10 2013 006 138

(51) Int. Cl.
*F04B 39/08* (2006.01)
*F04B 49/22* (2006.01)
(Continued)

(52) U.S. Cl.
CPC ..... *F04B 49/225* (2013.01); *F04B 7/0007* (2013.01); *F04B 7/0046* (2013.01);
(Continued)

(58) Field of Classification Search
CPC .... F04B 49/243; F04B 49/225; F04B 39/108; F04B 39/1073; F04B 49/16; F04B 7/007; F04B 7/0046; F04B 7/0061
(Continued)

(56) References Cited

U.S. PATENT DOCUMENTS 2,139,313 A * 12/1938 Neubauer ..... F04B 39/0016 137/512
3,351,271 A 11/1967 Bellmer
(Continued)

FOREIGN PATENT DOCUMENTS

CN 2109465 U 7/1992
CN 201096070 Y 8/2008
(Continued)

OTHER PUBLICATIONS

Chinese Office Action issued in counterpart Chinese Application No. 201480020383.7 dated Apr. 27, 2016, with partial English translation (seven (7) pages).
(Continued)

*Primary Examiner* — Devon Kramer
*Assistant Examiner* — Christopher Bobish
(74) *Attorney, Agent, or Firm* — Crowell & Moring LLP

(57) ABSTRACT

A device for conserving power is provided in a piston compressor, in particular a piston-compressor for generating compressed air in a motor vehicle and having a piston delimiting a compression chamber for generating compressed air, which, originating from the ambient environment, arrives in the compression chamber for compression by way of at least one suction connection formed on a cylinder head cover and an intake valve array arranged on a valve plate. For the purpose of conserving power, a pressure-dependently acting idling device is provided for the intake valve array having a dedicated suction lamella, which can be rotated by an actuator between a working position overlapping at least one suction opening and an idling position unblocking, at least in part, the at least one suction opening. The actuator actuates the suction lamella in a coordinated manner such that in the idling position, the suction lamella unblocks the at least one suction opening in the valve plate,
(Continued)

at least partially, while simultaneously blocking adjacent pressure valve cross-sections, at least partially, and locks the suction connection at the cylinder head cover by a slider in order to form an increased dead space in the area of the cylinder head.

11 Claims, 5 Drawing Sheets

(51) Int. Cl.

| | |
|---|---|
| ***F04B 49/16*** | (2006.01) |
| ***F04B 49/24*** | (2006.01) |
| ***F04B 39/10*** | (2006.01) |
| *F04B 7/00* | (2006.01) |

(52) U.S. Cl.
CPC ..... *F04B 39/1073* (2013.01); *F04B 49/16* (2013.01); *F04B 49/243* (2013.01); *F04B 7/0061* (2013.01); *F04B 39/08* (2013.01)

(58) Field of Classification Search
USPC ..... 417/298, 446; 137/854, 855
See application file for complete search history.

(56) References Cited

U.S. PATENT DOCUMENTS 4,932,631 A * 6/1990 Heger ..... F04B 39/08 251/228
5,101,857 A * 4/1992 Heger ..... F04B 39/1086 137/601.15
5,980,219 A * 11/1999 Spurny ..... F04B 49/243 417/296
6,082,978 A 7/2000 Tetour et al.
6,261,068 B1 7/2001 Kramer et al.

FOREIGN PATENT DOCUMENTS

| | | | |
|---|---|---|---|
| CN | 201225264 | Y | 4/2009 |
| DE | 33 29 790 | A1 | 2/1985 |
| DE | 197 39 662 | A1 | 3/1999 |
| DE | 198 48 217 | A1 | 4/2000 |
| EP | 0 544 105 | A1 | 6/1993 |
| FR | 1 098 045 | A | 7/1955 |

OTHER PUBLICATIONS

International Search Report (PCT/ISA/210) issued in PCT Application No. PCT/EP2014/000908 dated Aug. 29, 2014 with English-language translation (four (4) pages).
International Preliminary Report on Patentability (PCT/IB/326 & PCT/IB/373), including Written Opinion (PCT/ISA/237) issued in PCT Application No. PCT/EP2014/000908 dated Oct. 22, 2015 (seven (7) pages).

* cited by examiner

DEVICE FOR CONSERVING POWER IN A PISTON COMPRESSOR

CROSS REFERENCE TO RELATED APPLICATIONS

This application is a continuation of PCT International Application No. PCT/EP2014/000908, filed Apr. 4, 2014, which claims priority under 35 U.S.C. § 119 from German Patent Application No. 10 2013 006 138.5, filed Apr. 10, 2013, the entire disclosures of which are herein expressly incorporated by reference.

BACKGROUND AND SUMMARY OF THE INVENTION

The invention relates to a device for conserving power in a piston compressor, in particular for generating compressed air in a motor vehicle, having a piston arranged in an axially movable manner in a cylinder for generating compressed air, which enters a compression chamber of the cylinder for compression via at least one intake valve, wherein the intake valve interacts with pressure-controlled measures for conserving power.

The area of application of the invention extends primarily to reciprocating piston compressors for motor vehicle construction, especially commercial vehicle construction. Such compressors are used primarily to produce compressed air for compressed air systems in the motor vehicle.

To control the delivery rate of such piston compressors and to control the pressure in downstream loads, e.g. a brake system, devices for conserving power are widely known. These devices open the intake valve of the piston compressor when a predetermined pressure is reached and said pressure acts as a control pressure on a mechanical actuating element for the opening of the intake valve. Devices of this kind are widely known as "governor" devices.

As an alternative to such governor devices, DE 33 29 790 A1 discloses a technical solution according to which the suction lamella of the compressor is moved parallel to the plane of the valve carrier between a pumping position and an idling position by way of an actuating piston guided in the valve carrier. The suction openings of the compressor are in overlap with the suction lamella in the working position, whereas they are at least partially exposed in the idling or cutoff position. In this position, the piston of the compressor, which continues to operate, idles, that is to say air is drawn out of the suction chamber of the cylinder head, through the at least partially open suction openings, into the compression chamber and pushed back into the suction chamber through the suction openings. At the same time, however, a certain compression work continues to be performed in order to force a small proportion of air into the compression chamber during the compression stroke through the compression openings, which are open with respect to the compression chamber, wherein the pressure valve on the upper side of the valve plate opens up at a certain pressure level, as before. Compressed air passes out of the pressure chamber into the pressure regulator and is exhausted to atmosphere there via a relief valve.

This means therefore that a proportion of the air drawn in during the suction stroke leaves the cylinder chamber through the suction openings, while a proportion of the air which is present as before is expelled through the compression openings.

During this operating state, the lubricating oil in the crankcase has an increased tendency to creep upward along the piston rings due to the reduced pressure level in the compression chamber. The result is that the lubricating oil can ultimately enter the compression chamber and contribute to increased enrichment of the air with lubricating oil. In the case of prolonged operation at high temperatures, an increased incidence of carbon consequently has to be expected.

When the suction valve is open, i.e. when the suction lamella is in the idling position, suction work continues to be performed as operation of the piston compressor continues, that is to say air is drawn into the compression chamber of the compressor via the suction line, the open suction port and the suction valve, which is in the idling position, and is at least partially expelled again into the suction line if the piston of the compressor is performing compression work. The air drawn into the compression chamber is loaded with oil particles, which creep along the piston rings in the direction of the compression chamber due to the reduced pressure level in the cylinder chamber. This air loaded with oil particles is at least partially expelled again through the suction line, and the lubricating oil accumulates and then subsequently crosses over in a surge into the pressure line when there is a switch to the delivery mode.

If there is a turbocharger connected to the suction line in parallel with the piston compressor, generating a certain vacuum within the suction line by its suction effect, there is furthermore the risk that the oil particles in the air in the suction line will enter the turbocharger and contribute there to severe coking Such coking is, of course, highly undesirable.

FR 1 098 045 A describes a piston compressor, the suction valve of which has an actuating mechanism that serves to hold the valve open. This is a tappet which acts on the suction valve and which carries a piston that can be acted upon by the pressure in the pressure reservoir connected to the compressor, such that, after a pressure threshold is exceeded, the tappet is moved by the piston and, accordingly, the suction valve is opened. Provided outside the piston compressor, in the suction line thereof, is a nonreturn flap which opens when a vacuum arises in the suction line in order to draw air into the piston compressor. The pressure valve of the piston compressor is unaffected by the actuation of the suction valve, which is always in a position ready for operation, with the result that a certain compression work is always performed, even in the idling position of the suction valve. As in the case of the prior art solution discussed above, the pressure valve opens above a certain pressure level, as a result of which compressor work is performed. Owing to the reduced pressure level in the compression chamber in the idling position, there is the problem, even with designs of this kind, that the lubricating oil can flow upward along the piston rings, i.e. into the compression chamber, and hence that there is enrichment of the air with lubricating oil. Moreover, the nonreturn flap gives rise to throttling losses which have a disadvantageous effect on the efficiency of the compressor. Taking this as a starting point, it is the object of the present invention to provide a device for conserving power in a piston compressor, by which power conservation that is as complete as possible is achieved in the cutoff or idling phase and that lubricating oil cannot unnecessarily enter the compression chamber from the crankcase and contribute there to oil enrichment of the air in the suction line.

This and other objects are achieved according to the invention by a device for conserving power in a piston compressor, in particular for generating compressed air in a motor vehicle, having a piston, which delimits a compression chamber, for generating compressed air, which, originating from the ambient environment, enters the compression chamber for compression via at least one suction port formed on a cylinder head cover and via an intake valve array arranged on a valve plate. For the purpose of conserving power, a pressure-dependently acting idling device is provided for the intake valve array, which is provided with an associated suction lamella and can be rotated by an actuator between a working position overlapping at least one suction opening and an idling position exposing, at least in part, the at least one suction opening. The actuator actuates the suction lamella in a coordinated manner such that, in the idling position, the lamella exposes the at least one suction opening in the valve plate while simultaneously closing adjacent pressure valve cross sections, at least partially, and blocks the suction port on the cylinder head cover by way of a slider in order to form an increased dead space in the region of the cylinder head.

The invention incorporates the technical teaching that the actuator actuates the suction lamella of the valve plate in a coordinated manner in such a way that, in the idling position, the lamella at least partially closes the at least one pressure valve opening in the valve plate or a comparable component while simultaneously exposing adjacent suction valve cross sections, and blocks the suction port on the cylinder head cover or a comparable component by way of a slider or the like in order to form an increased dead space in the region of the cylinder head.

Optimization of power conservation is achieved by way of the movement of the suction lamella into the open position being performed in the idling position and by way of the simultaneously performed, at least partial closure of the suction port on the cylinder head cover by the slider within the cylinder head. In the idling phase, the movable suction lamella in combination with the slider ensures that the suction line and, where applicable, filters and compressor systems connected to the suction line, remain unaffected by the continued idling of the piston. By means of the simultaneous, at least partially performed closure of the at least one pressure valve cross section of the piston compressor, it is furthermore ensured that there is no unnecessary discharge of air. As a result, all that is necessary is to draw in a small volume corresponding to the leakage losses via a check valve, preferably situated on the slider, when the piston of the compressor performs a suction movement in the idling position of the suction lamella. When the pressure openings of the compressor are fully closed, the additional quantity of air to be drawn in from the suction line is reduced to the actually existing leakage volume, also referred to as blow by, in the compression chamber of the cylinder.

The suction lamella, in the form of a sliding or rotary lamella, can be moved with the aid of the actuator, with control by a pressure regulator or by a control signal provided in some other way, out of its working position into the idling position, in which the at least one suction opening is either partially or completely exposed, such that the air drawn into the compression chamber can flow back into the suction chamber. The power conservation that can be achieved by this measure is of the order of about 60%.

The solution according to the invention ensures that no unnecessary air volume is displaced on the pressure side of the compressor. Especially in the case of turbochargers or compressors connected in parallel to the suction line of the piston compressor, the occurrence of coking in these at high temperatures due to the intake of air loaded with lubricating oil is also prevented. Moreover, the solution according to the invention does not have a disadvantageous effect on the efficiency of the compressor in the delivery phase, and therefore throttling losses are avoided.

The suction lamella is designed in such a way that it operates without friction. As a result, there is no wear between the suction lamella and the valve plate, even when there is very little lubricating oil in the compression chamber. Thus, this design is particularly suitable for compressors with reduced oil discharge and for oil-free compressor types.

It is advantageous if the suction lamella is designed in such a way that the pressure openings are completely or partially closed in the idling phase, depending on requirements. Unnecessary movement of a proportion of the volume of air into the pressure chamber thus does not occur. Only if a certain residual air delivery to avoid icing or soiling is desired is partial opening of the pressure openings in the valve plate set. Moreover, the closure of the suction port leads to a certain backpressure in the compression chamber, which contributes to keeping the lubricating oil out of the crankcase. The partial or complete coverage of the suction openings thus contributes to a further optimization in the power conservation that can be achieved.

In a preferred embodiment of the invention, the actuator, which is activated, preferably pneumatically, to move the suction lamella and the slider, acts substantially parallel to the plane of the valve plate and has an actuating piston that can be subjected to a control pressure. Here, the actuating piston can be guided in a bore in the cylinder head cover, which can be formed in the cylinder head cover in a casting process.

The actuating piston preferably acts by way of a driver pin extending through the bore on an actuating member, which can rotate the suction lamella between the working position and the idling position, and on the slider, which closes the suction port.

According to a preferred embodiment, the slider, which closes the suction port in the cylinder head cover, is designed as a pivoted slider pivotally attached thereto and is situated within the cylinder head cover.

The slider is furthermore preferably provided with a minimum air valve in the region that closes the suction port. According to a preferred embodiment, the minimum air valve, which is designed as a check valve, is a reed valve, which comprises a minimum air stop, formed as an aperture at the end of the slider, with a valve reed interacting therewith.

According to a preferred embodiment of the invention, the plurality of suction openings formed in the valve plate are arranged in a circular ring shape and can be closed by use of a suction lamella designed as a disk-shaped rotary lamella having apertures and openings. Moreover, a plurality of pressure valve cross sections formed in the valve plate can furthermore be arranged in a circular ring shape, opening within the cylinder cover into a pressure chamber with a connection to the pressure line, and can be closed alternately by the disk-shaped suction lamella. These pressure valve cross sections interact with a pressure valve unit, preferably comprising a pressure valve stop, a pressure valve spring and a pressure valve reed, which is arranged within the cylinder head on the delivery line side.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
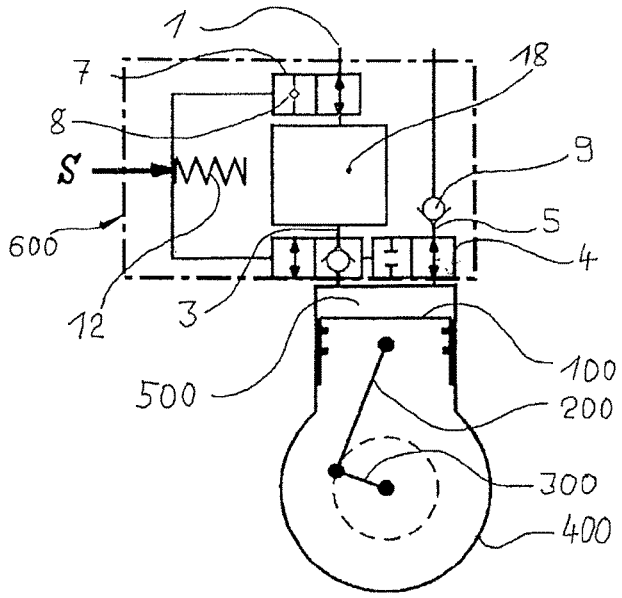
FIG. 1 is a schematic illustration of a piston compressor with a device for conserving power interacting therewith.

According to FIG. 1, a piston compressor for generating compressed air essentially comprises a piston 100, which is pivotally attached to a driven crankshaft 300 by a connecting rod 200. The crankshaft 300 is mounted for rotation in a crankcase 400. The crankcase 400 contains a cylinder which, together with the piston 100, forms a compression chamber 500, which is provided at the end with a cylinder head 600—shown here only schematically—having a device for conserving power integrated therein.

The cylinder head 600 comprises a slider 7, which operates as a 2/2-way valve, controls a suction port 1 of the piston compressor and has an integrated minimum air valve 8. The ambient air drawn in via the suction port 1 passes via the slider 7 within the cylinder head 600 into an intake chamber 18, which is formed therein and serves as a selectable dead space. In the direction of the compression chamber 500, the intake chamber 18 opens in the cylinder head 600 via a valve plate—not shown specifically—into suction openings 3 that are formed.

The suction openings 3 are controlled by way of a 2/2-way valve configuration designed as a suction lamella 4 in order, in the valve position shown, which corresponds to the working position of the compressor, to prevent compressed air from flowing back into the intake chamber 18 by way of a check valve function and to expel the compressed air produced via at least one pressure bore 5, likewise formed in the valve plate, with a downstream pressure valve unit 9. More specifically, as shown here, in the absence of a control pressure S applied to the actuator for the device for conserving power, the mechanism is pushed into the working position by the spring force of a return spring 12. When there is a control pressure S applied, in the other operating position (not shown here) of the suction lamella 4, the pressure bores 5 are at least partially closed and the suction openings 3 are opened. The piston 100 then only performs compression into the now closed intake chamber 18.

Any leakage losses which flow past the piston 100, for example, are compensated by the check valve function of the minimum air valve 8. The minimum air valve 8 of the slider 7 also serves to ensure a reduced delivery rate in the case of a mechanism locked in the closed position and, to this extent, provides a safety function.

Figure 2:
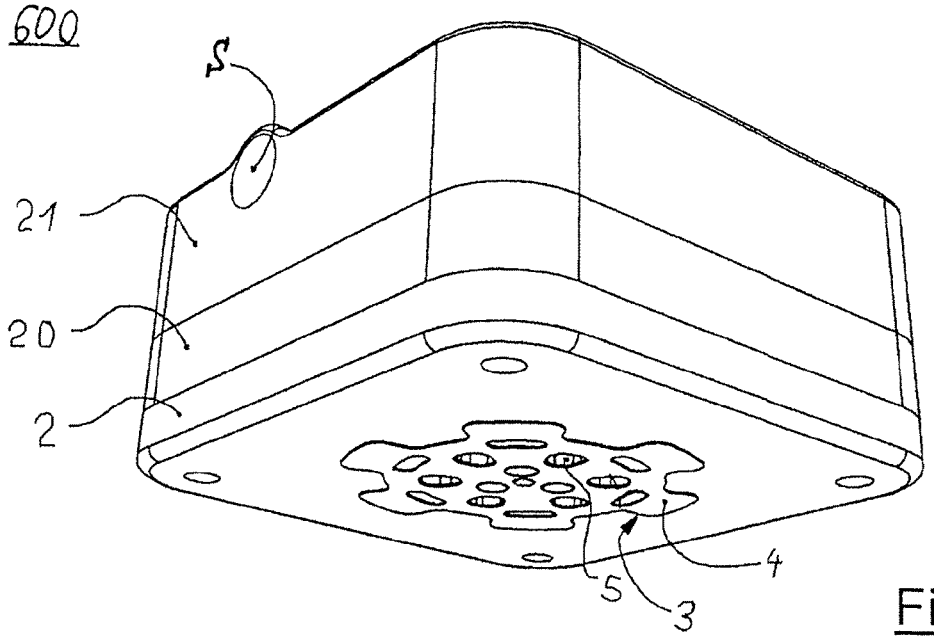
FIG. 2 is a perspective view of a piston compressor cylinder head comprising a valve plate and a cylinder head cover, with an integrated device for conserving power.

According to FIG. 2, the cylinder head 600 essentially comprises, in the external view, a valve plate 2, on which an intermediate plate 20 for the extended accommodation of the device for conserving power is mounted. The intermediate plate 20 is adjoined by a cylinder head cover 21. An opening for the supply of the control pressure S for the actuator, accommodated within the cylinder head 600, for the device for conserving power is arranged in the cylinder head cover 21.

The suction lamella 4, which is designed as a disk-shaped rotary lamella, is arranged on the underside of the valve plate 2. Here, the suction lamella 4 is in the working position, wherein—as in FIG. 1—the pressure bores 5 introduced into the valve plate 2 in a circular ring arrangement are open, while suction openings 3 (not visible) concealed by the suction lamella 4 and likewise arranged in a circular ring shape in the valve plate 2 are covered here.

In contrast to the external view described above, FIG. 3 illustrates a partially sectioned bottom view of the device for conserving power, omitting the intermediate plate 20 and the cylinder head cover 21 while providing a detailed illustration of the actuator for the device for conserving power in the working position.

The pneumatically controlled actuator comprises an actuating piston 11, which is guided parallel to the plane of the valve plate 2 and can be subjected to the control pressure S. The actuator is in the initial position free from control pressure. In this arrangement, a driver pin 17 coupled to the actuating piston 11 acts via a pivoted lever 10 with a pivoted lever spindle 14 for actuation on the suction lamella 4 in order to switch the latter between the working position and the idling position. At the same time, the driver pin 17 of the actuating piston 11 actuates the slider 7, which serves to control the suction port 1—not shown specifically—which, being pivotally attached by way of a pivot bearing 13, is designed as a pivoting slider. In the region which closes the suction port 1, the slider 7 is provided with a minimum air valve 8*a*, 8*b*.

In the working position shown, the suction lamella 4 closes the suction openings 3 formed in the valve plate 2, whereas adjacent pressure valve cross sections 5 are simultaneously exposed by way of apertures 6 in the suction lamella 4. The pressure valve cross sections 5 interact with a pressure valve unit 9*a*-9*c*, which form a check valve toward the delivery side.

Figure 3:
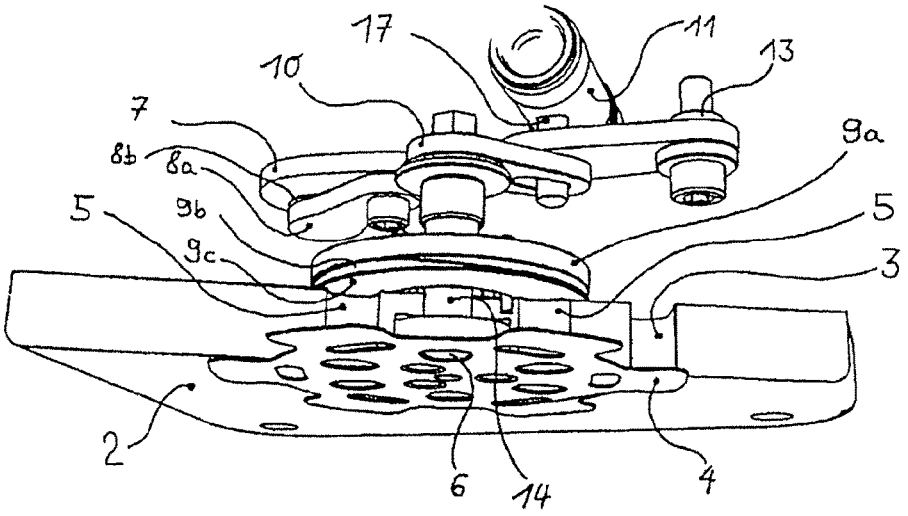
FIG. 3 is a perspective view of an actuator of the device for conserving power (from below), said actuator interacting with the valve plate (shown in section)
Figure 4:
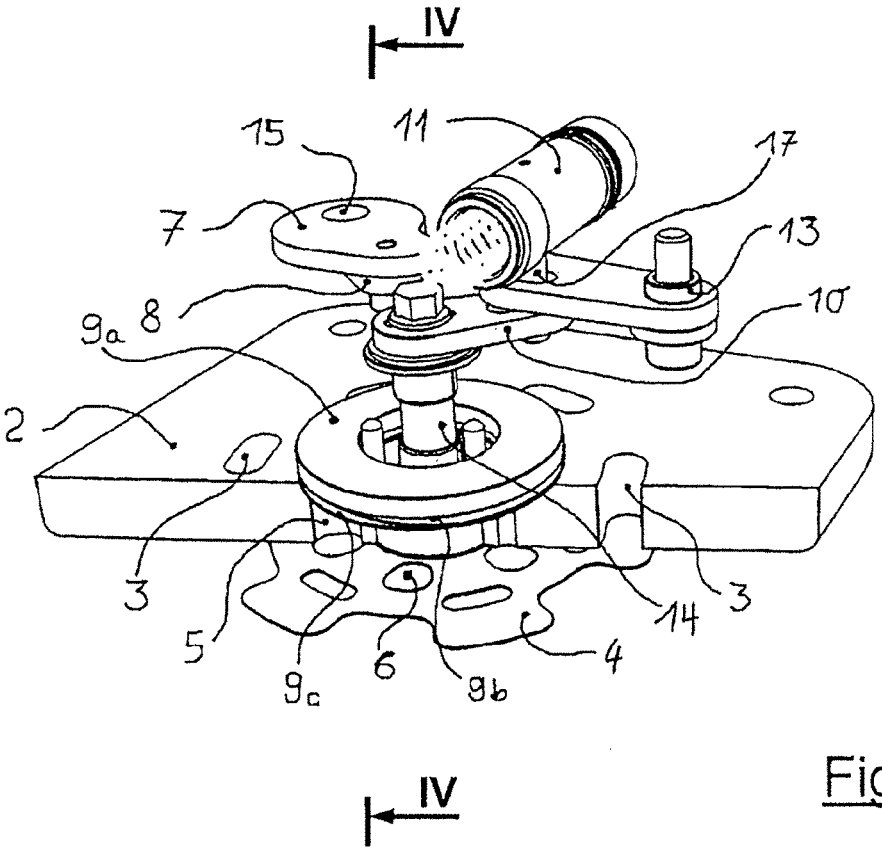
FIG. 4 is a perspective view of the actuator of the device for conserving power (from above), said actuator interacting with the valve plate (shown in section)

FIG. 4 is a plan view of the mechanism shown in FIG. 3, wherein the reference signs used above in connection with FIG. 3 apply, using the above detailed description. Here, the functional position of the actuator of the device for conserving power is thus illustrated graphically. Moreover, it can be seen that the slider 7 is provided at the end associated with the suction port 1—not shown specifically here—with a minimum air intake opening 15 of the minimum air valve 8—not shown specifically here.

Figure 5:
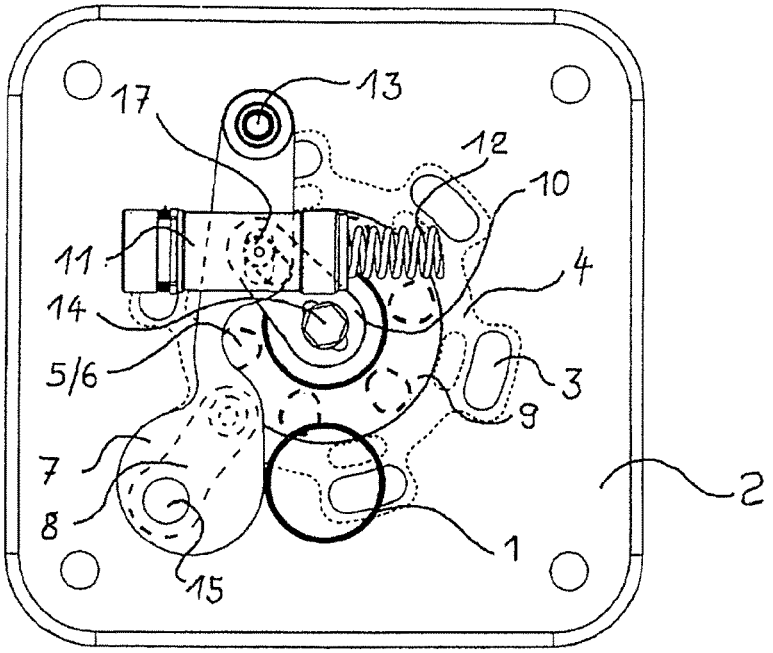
FIG. 5 is a plan view of the valve plate with the actuator for the device for conserving power, in a working position.

According to FIG. 5, the device for conserving power is shown in the working position, using the component designations in accordance with the preceding detailed description. Here, the suction lamella 4 mounted on the valve plate 2 conceals the suction openings 3 formed in the valve plate 2, and the adjacent pressure valve cross sections 5 of the valve plate 2 are open via the apertures 6 in the suction lamella 4. At the same time, the suction port 1 in the cylinder head—not shown specifically—is in the open position because of the slider 7 having been pivoted away therefrom. This working position is reached in the state of the actuating piston 11 in which it is free from control pressure, the piston being pushed into the initial position by a return spring 12.

Figure 6:
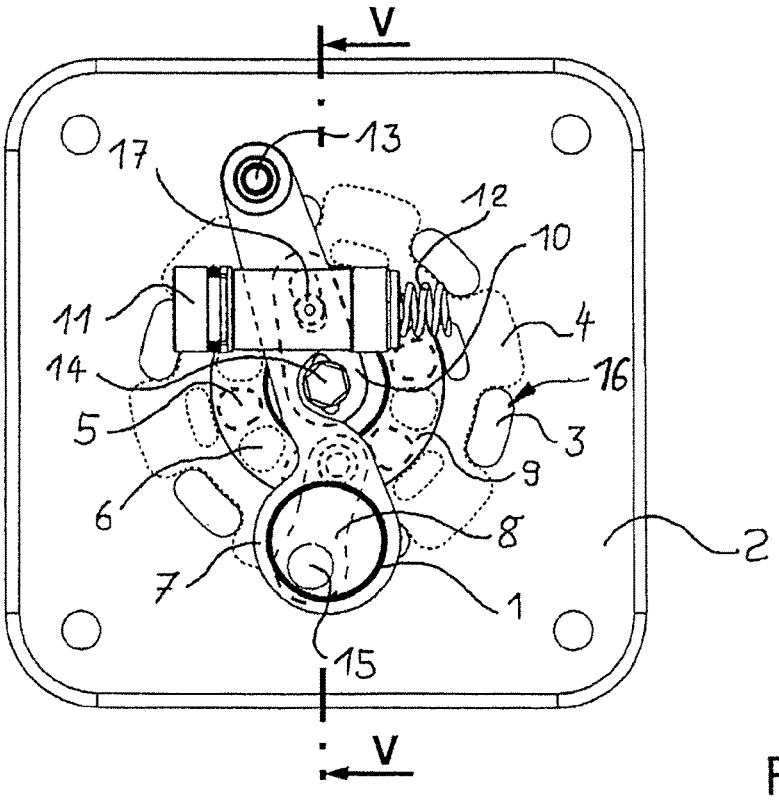
FIG. 6 is a plan view of the valve plate with actuator for the device for conserving power, in an idling position.

In FIG. 6, in contrast, the actuating piston 11 is subject to control pressure, with the result that the device for conserving power is in the idling position. Here, the suction openings 3 in the valve plate 2 are opened by openings 16 in the suction lamella 4, whereas the pressure valve cross sections 5 are closed since they do not coincide with the corresponding apertures 6 in the suction lamella 4. At the same time, the suction port 1 in the cylinder head—not shown specifically here—is closed by the end of the slider 7, with the result that air can flow only via the minimum air valve 8, through the minimum air intake opening 15, into the intake chamber 18—not shown here.

Figure 7:
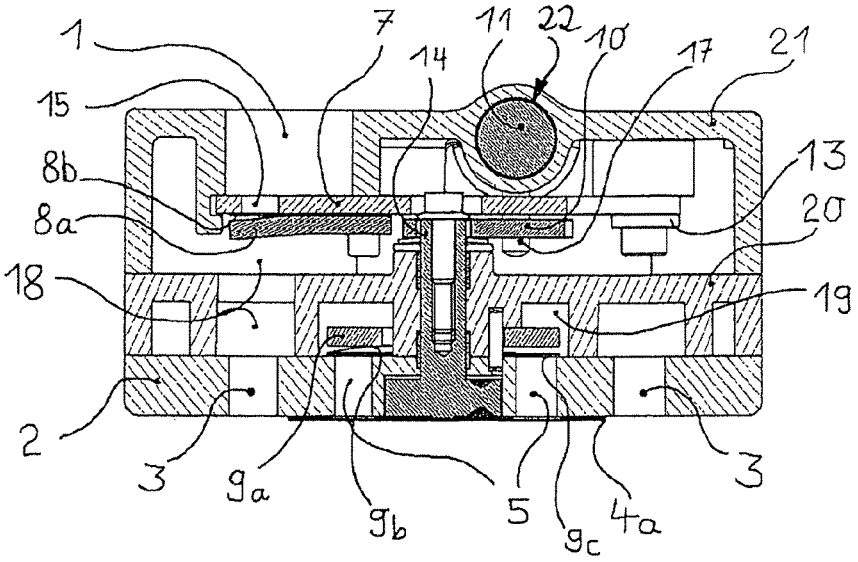
FIG. 7 is a section view taken along line V-V in FIG. 6, showing actuator situated within the cylinder head, in the idling position.

FIG. 7 is a sectioned view taken along line V-V in FIG. 6 and illustrates the device for conserving power in the idling position. As is evident, the actuating piston 11 of the actuator for the device for conserving power is guided in a corresponding bore 22 in the cylinder head cover 21 to form a piston-cylinder unit, which is subjected to the control pressure. The driver pin 17 arranged on the outer circumference of the actuating piston 11 extends through a slotted opening in the cylinder head cover 21 into the slider 7, which is designed as a pivoted lever.

The driver pin 17 is furthermore used to actuate the pivoted lever 10, which actuates the suction lamella 4 via the pivoted lever spindle 14. The pressure valve unit, which interacts with the pressure valve cross sections 5 in the valve plate 2, comprises a pressure valve stop 9*a*, a pressure valve spring 9*b* and a pressure valve reed 9*c*, which is here arranged in the region of the intermediate plate 20 of the cylinder head. In respect of the remaining reference signs, the above detailed description otherwise applies.

Figure 8:
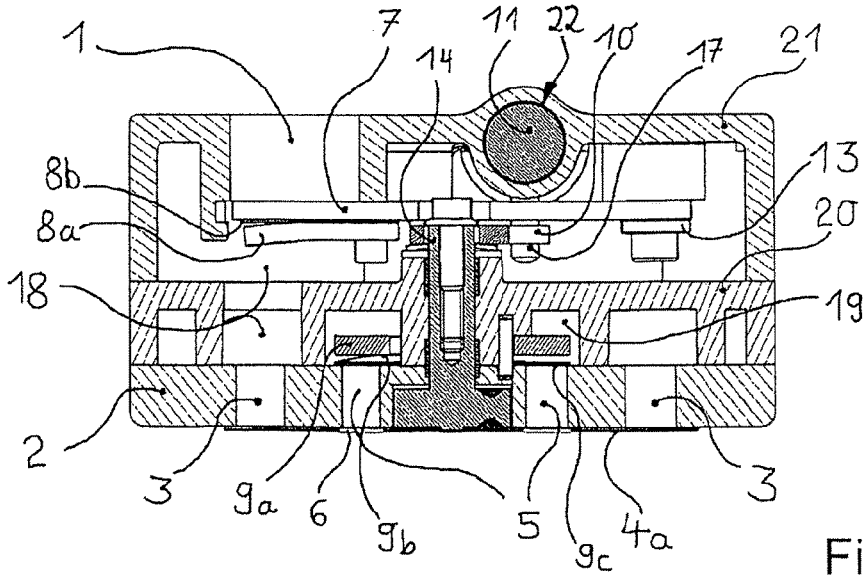
FIG. 8 is a section view taken along line IV-IV in FIG. 5, showing actuator situated within the cylinder head, in the working position.

FIG. 8 is a sectioned view taken along line IV-IV in FIG. 4 and illustrates the device for conserving power in the working position. Here too, in respect of the reference signs used, the above detailed description otherwise applies.

Figure 9:
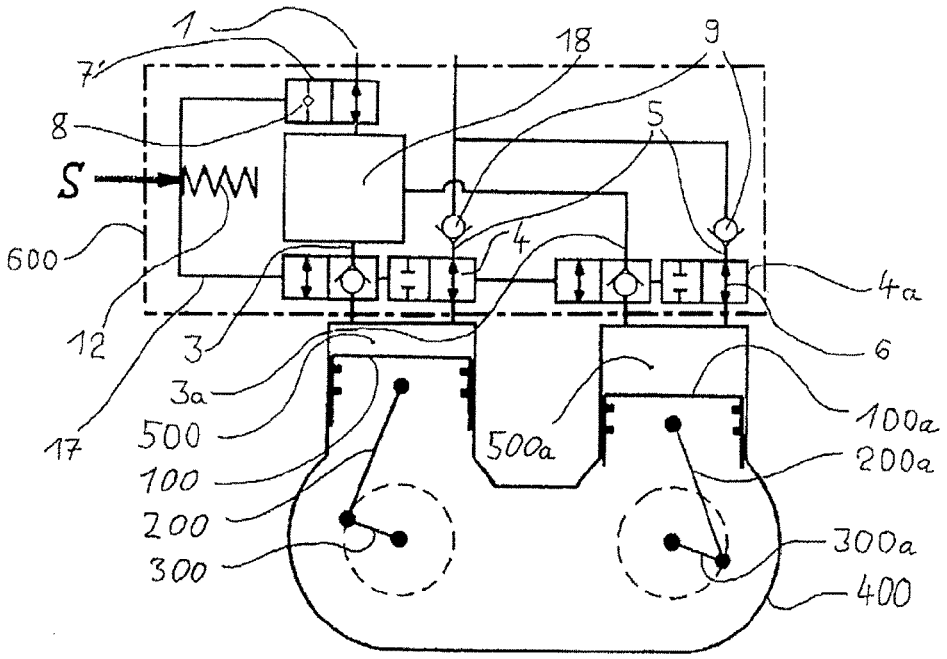
FIG. 9 is a schematic illustration of a twin cylinder design of a piston compressor with a device for conserving power interacting therewith.

FIG. 9 shows a twin-cylinder design of a piston compressor, in which the same intake chamber 18 is used by both cylinders. There is only one slider 7' since there is only one suction port 1 in this embodiment too. Each compression chamber 500 and 500*a* is assigned a dedicated pivotable suction lamella 4 and 4*a* respectively. In the idling phase, one piston 100 then displaces the air via the intake chamber 18 into the other compression chamber 500*a*, which, with a 180° phase displacement, has a downward-moving piston 100*a* at precisely this moment, i.e. is exerting suction. Owing to the large open cross section of the suction openings 3, 3*a* and the possibility of free flow through the intake chamber 18, only very low throttling losses occur. Here too, the cylinder pressure can be configured in such a way, by means of the size of the exposed suction passage cross sections, that sufficient backpressure remains to avoid oil transfer.

LIST OF REFERENCE SIGNS

1 suction port
2 valve plate
3 suction opening
4 suction lamella
5 pressure valve cross section
6 aperture
7 slider
8 minimum air valve
9 pressure valve unit
10 pivoted lever
11 actuating piston
12 return spring
13 pivot bearing
14 pivoted lever spindle
15 minimum air intake opening
16 opening
17 driver pin
18 intake chamber
19 pressure chamber (delivery side)
20 intermediate plate
21 cylinder head cover
22 bore
100 piston
200 connecting rod
300 crankshaft
400 crankcase
500 compression chamber
600 cylinder head
S control pressure The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A power conservation device in a piston compressor that generates compressed air for a vehicle, the piston compressor being equipped with a piston delimiting a compression chamber for generating compressed air which, originating from an ambient environment enters the compression chamber by way of at least one suction port formed on a cylinder head cover and an intake valve array arranged on a valve plate, the power conservation device comprising:

a pressure-dependent acting idling device configured for the intake valve array, the pressure-dependent acting idling device having an associated suction lamella; and an actuator configured to rotate the suction lamella between a working position overlapping at least one suction opening and an idling position exposing, at least in part, the at least one suction opening, wherein the actuator actuates the suctions lamella in a coordinated manner such that, in the idling position, the lamella unblocks the at least one suction opening in the valve plate while simultaneously blocking adjacent pressure valve cross sections, at least partially, and blocks the at least one suction port on the cylinder head cover by way of a slider in order to form an increased dead space in a region of the cylinder head.

2. The power conservation device according to claim 1, wherein the actuator is a pneumatically controlled actuator comprising an actuating piston guided substantially parallel to a plane of the valve plate in the region of the cylinder head cover, the actuating piston being subjected to a control pressure.

3. The power conservation device according to claim 2, wherein the actuating piston is guided in a bore in the cylinder head cover.

4. The power conservation device according to claim 2, further comprising a return spring configured to bias the actuating piston into an initial position corresponding to a working position of the piston compressor when the control pressure is not acting on the actuating piston.

5. The power conservation device according to claim 2, wherein the actuating piston acts via a driver pin coupled thereto on a pivoted lever spindle, the pivoted lever spindle rotating the suction lamella between the working position and the idling position, and the actuating piston acting via the driver pin coupled thereto on the slider which closes the at least one suction port.

6. The power conservation device according to claim 3, wherein the actuating piston acts via a driver pin coupled thereto on a pivoted lever spindle, the pivoted lever spindle rotating the suction lamella between the working position and the idling position, and the actuating piston acting via the driver pin coupled thereto on the slider which closes the at least one suction port.

7. The power conservation device according to claim 1, wherein the slider that closes the at least one suction port is configured as a pivoted slider that is pivotally attached to the cylinder head cover.

8. The power conservation device according to claim 1, wherein the slider is provided with a minimum air valve in the region that closes the at least one suction port.

9. The power conservation device according to claim 8, wherein the minimum air valve is configured as a reed valve, the reed valve comprising a minimum air valve stop, formed as an aperture at an end of the slider, the aperture having a valve reed interacting therewith.

10. The power conservation device according to claim 1, wherein the at least one suction opening in the valve plate is a plurality of suction openings formed in the valve plate which are arranged in a circular ring shape and interact with the suction lamella, which is configured as a disc-shaped rotary lamella having apertures and openings.

11. The power conservation device according to claim 10, wherein the adjacent pressure valve cross sections are a plurality of pressure valve cross sections formed in the valve plate which are also arranged in a circular ring shape and interact alternately with the disc-shaped rotary lamella in a valve manner.

* * * * *